US011813852B2

(12) United States Patent
Matsumoto et al.

(10) Patent No.: US 11,813,852 B2
(45) Date of Patent: Nov. 14, 2023

(54) PRINTING APPARATUS AND METHOD OF CONTROLLING THE SAME

(71) Applicant: CANON KABUSHIKI KAISHA, Tokyo (JP)

(72) Inventors: Yasunori Matsumoto, Kanagawa (JP); Takaaki Aoyagi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 17/547,336

(22) Filed: Dec. 10, 2021

(65) Prior Publication Data

US 2022/0203718 A1 Jun. 30, 2022

(30) Foreign Application Priority Data

Dec. 25, 2020 (JP) ..... 2020-217371

(51) Int. Cl.
*B41J 11/42* (2006.01)

(52) U.S. Cl.
CPC ..... *B41J 11/42* (2013.01)

(58) Field of Classification Search
CPC ..... B41J 11/42
See application file for complete search history.

(56) References Cited

U.S. PATENT DOCUMENTS 9,586,780 B2 3/2017 Nishida et al.
2020/0317457 A1* 10/2020 Fujino ..... B65H 7/06

FOREIGN PATENT DOCUMENTS

JP 4921055 B2 4/2012
JP 2015-168237 A 9/2015

* cited by examiner

*Primary Examiner* — Justin Seo
(74) *Attorney, Agent, or Firm* — Venable LLP

(57) ABSTRACT

A printing apparatus comprises a first roller for conveying sheets, a first motor for driving the first roller, a second roller for conveying sheets, a second motor for driving the second roller, and a conveyance controller that controls conveyance to be able to execute a first conveyance operation for conveying sheets such that the trailing edge of a preceding sheet and the leading edge of a succeeding sheet overlap, and a second conveyance operation for conveying sheets by arranging a distance between the trailing edge of the preceding sheet and the leading edge of the succeeding sheet. The conveyance controller, based on information indicating whether the second motor is in a temperature rising state, controls whether to execute the first conveyance operation or to execute the second conveyance operation.

16 Claims, 14 Drawing Sheets

PRINTING APPARATUS AND METHOD OF CONTROLLING THE SAME

BACKGROUND OF THE INVENTION

Field of the Invention

The present invention relates to a printing apparatus for printing on a sheet by a printing head, and more particularly, to a printing apparatus for conveying a sheet to a printing area facing the printing head in a state in which a part of a preceding sheet and a part of a succeeding sheet overlap with each other.

Description of the Related Art

Japanese Patent Laid-Open No. 2015-168237 describes a printing apparatus in which, in order to improve the throughput of continuous printing for a plurality of printing sheets, a preceding sheet and a succeeding sheet are fed with predetermined intervals therebetween, and thereafter an operation is performed so that the leading edge of the succeeding sheet overlaps the preceding sheet and the succeeding sheet is conveyed to a position facing the printing head.

Further, Japanese Patent No. 4921055 discloses a printing apparatus that detects a temperature rise of a conveyance motor during printing of a printing sheet and lowers the speed of the conveyance motor.

Here, in the configuration of Japanese Patent Laid-Open No. 2015-168237, when the leading edge of the succeeding sheet being conveyed by the feeding roller passes through a predetermined position, in order to overlap the succeeding sheet on the trailing edge of the preceding sheet, the feeding roller uniformly switches to high-speed driving, regardless of the position of the trailing edge of the preceding sheet. Therefore, after the high-speed driving of the feeding roller is started, when the speed of the conveyance motor for conveying the preceding sheet is lowered due to the temperature rise or the like of the conveyance motor, the succeeding sheet may collide with the trailing edge of the preceding sheet. When an attempt is made to avoid a collision with the preceding sheet whose speed is decreased while the succeeding sheet is being conveyed at a high speed, the feeding roller for conveying the succeeding sheet is repeatedly driven and stopped. At this time, there is a problem that a conveyance deviation of the succeeding sheet is caused by influence of the backlash of the driving unit.

SUMMARY OF THE INVENTION

The present invention has been made in view of the above-mentioned problems, and in a case where a preceding sheet and a succeeding sheet are conveyed, the succeeding sheet is conveyed so as to suppress conveyance deviation even in a case where the speed of the conveyance roller is reduced.

According to a first aspect of the present invention, there is provided a printing apparatus, comprising: a first roller configured to convey sheets; a first motor configured to drive the first roller; a second roller configured to convey sheets conveyed by the first roller; a second motor configured to drive the second roller; and a conveyance controller configured to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the conveyance controller, based on information indicating that the second motor is in a temperature rising state, controls whether to execute the first conveyance operation or to execute the second conveyance operation.

According to a second aspect of the present invention, there is provided a printing apparatus, comprising: a first roller configured to convey sheets; a first motor configured to drive the first roller; a second roller configured to convey sheets conveyed by the first roller; a second motor configured to drive the second roller; and a conveyance controller configured to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the conveyance controller, based on temperature information of the second motor, controls whether to execute the first conveyance operation or to execute the second conveyance operation.

According to a third aspect of the present invention, there is provided a method of controlling a printing apparatus comprising a first roller for conveying sheets, a first motor for driving the first roller, a second roller for conveying sheets conveyed by the first roller, and a second motor for driving the second roller, the method comprising: controlling conveyance to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the controlling conveyance, based on information indicating that the second motor is in a temperature rising state, controls whether to execute the first conveyance operation or to execute the second conveyance operation.

According to a fourth aspect of the present invention, there is provided a method of controlling a printing apparatus comprising a first roller for conveying sheets, a first motor for driving the first roller, a second roller for conveying sheets conveyed by the first roller, and a second motor for driving the second roller, the method comprising: controlling conveyance to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the controlling conveyance, based on temperature information of the second motor, controls whether to execute the first conveyance operation or to execute the second conveyance operation.

Further features of the present invention will become apparent from the following description of exemplary embodiments with reference to the attached drawings.

DESCRIPTION OF THE EMBODIMENTS

Hereinafter, an embodiment of the present invention is described in detail with reference to the accompanying drawings.

FIG. 1 to FIG. 4 are cross-sectional views for explaining an operation of overlapped continuous feeding in the printing apparatus according to the embodiment of the present invention (an operation of overlapping the leading edge of the succeeding sheet on the trailing edge of the preceding sheet and conveying the sheet). First, a schematic configuration of a printing apparatus capable of executing an operation of overlapped continuous feeding in the present embodiment is described with reference to the view illustrated in ST1 of FIG. 1.

Figure 1:
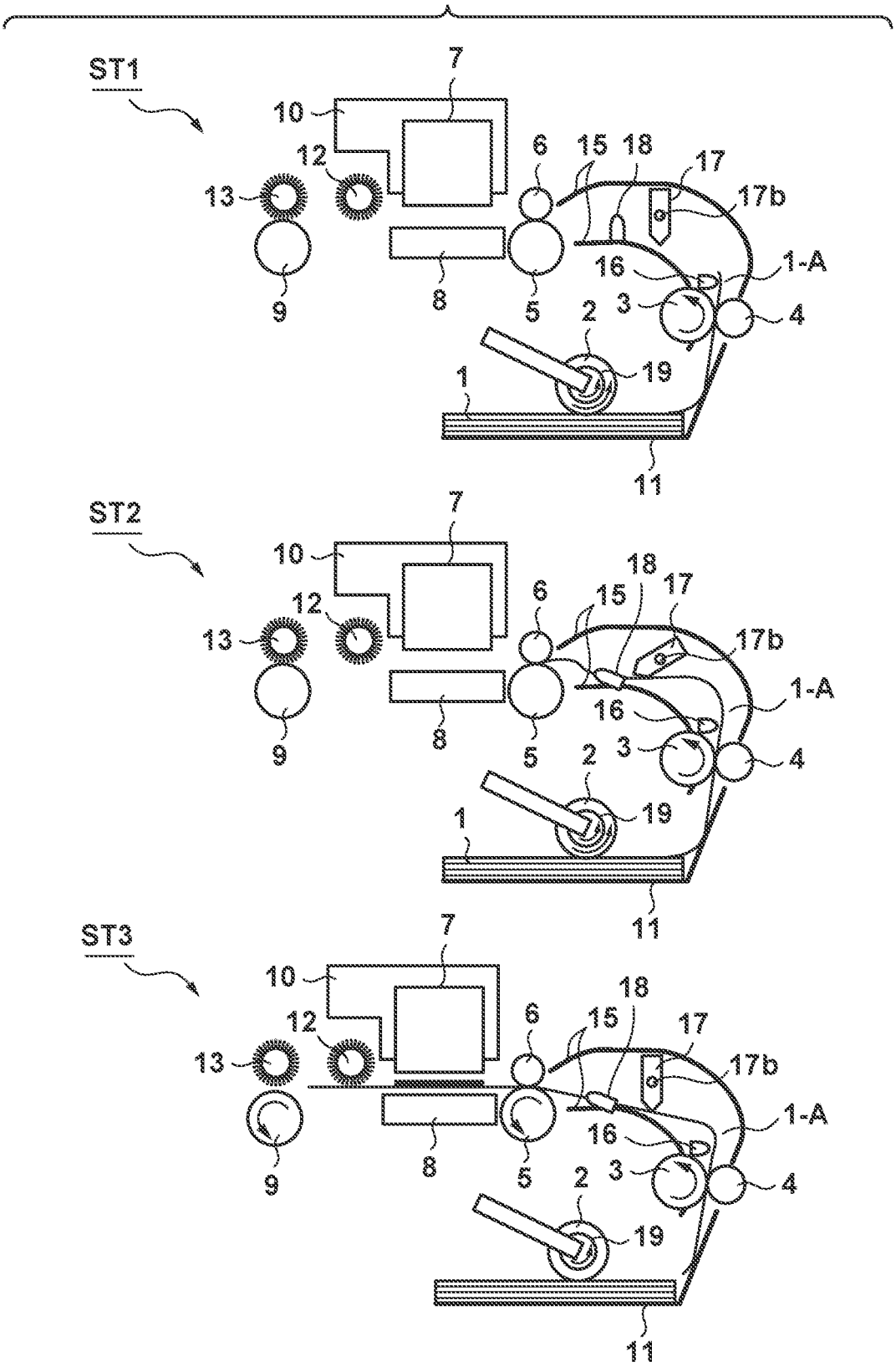
FIG. 1 is a view illustrating an operation of overlapped continuous feeding in a printing apparatus according to an embodiment of the present invention.

In ST1 of FIG. 1, reference numeral 1 denotes printing sheets. A plurality of printing sheets 1 are stacked in a feeding tray 11 (stacking unit). Reference numeral 2 is a pick-up roller that comes into contact with the uppermost printing sheet 1 stacked on the feeding tray 11 and picks up the printing sheet. Reference numeral 3 is a feeding roller for feeding the printing sheet 1 picked up by the pick-up roller 2 to the downstream side in the sheet conveyance direction. Reference numeral 4 is a feed driven roller biased to the feeding roller 3 and for feeding by sandwiching the printing sheet 1 together with the feeding roller 3.

Reference numeral 5 is a conveyance roller for conveying the printing sheet 1 fed by the feeding roller 3 and the feed driven roller 4 to a position facing the printing head 7. Reference numeral 6 is a pinch roller biased to the conveyance roller 5 and for conveying by sandwiching the printing sheet together with the conveyance roller 5.

Reference numeral 7 is a printing head for performing printing on the printing sheet 1 conveyed by the conveyance roller 5 and the pinch roller 6. In the present embodiment, it is assumed that the printing head is an inkjet printing head which discharges ink from the printing head and performs printing on the printing sheet 1. Reference numeral 8 is a platen that supports the back surface of the printing sheet 1 at a position facing the printing head 7. Reference numeral 10 is a carriage that is mounted on the printing head 7 and moves in a direction intersecting the sheet conveyance direction.

Reference numeral 9 is a discharge roller for discharging a printing sheet on which printing was performed by the printing head 7 to the outside of the apparatus. Reference numerals 12 and 13 are spurs that rotate in contact with the printing surface of the printing sheet on which printing was performed by the printing head 7. Here, the spur 13 on the downstream side is biased to the discharge roller 9, and discharge roller 9 is not disposed at a position facing the spur 12 on the upstream side. The spur 12 is for preventing upward displacement of the printing sheet 1 and is also referred to as a pressing spur.

Between the feeding nip portion formed by the feeding roller 3 and the feed driven roller 4, and the conveying nip portion formed by the conveyance roller 5 and the pinch roller 6, the printing sheet 1 is guided by the conveying guide 15. Reference numerals 16 and 18 are sheet detection sensors for detecting the leading edge and the trailing edge of the printing sheet 1. The first sheet detection sensor 16 is disposed near the downstream side of the feeding roller 3 in the sheet conveyance direction, and the second sheet detection sensor 18 is disposed near the upstream side of the conveyance roller 5 in the sheet conveyance direction. Reference numeral 17 is a sheet holding lever for overlapping the leading edge portion of the succeeding sheet on the trailing edge portion of the preceding sheet. The sheet holding lever 17 is biased by a spring in the counterclockwise direction in the drawing around the rotation shaft 17*b*.

Figure 5A:
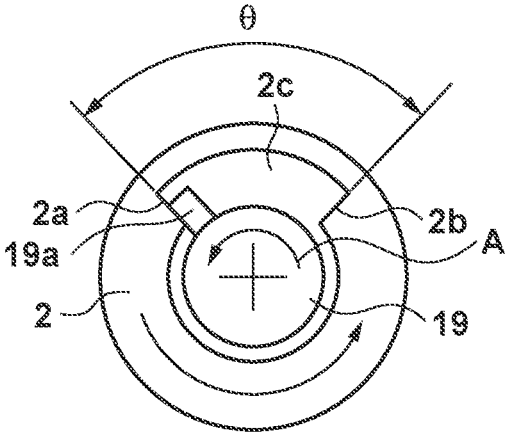
FIG. 5A and FIG. 5B are views illustrating a configuration of a pick-up roller.
Figure 5B:
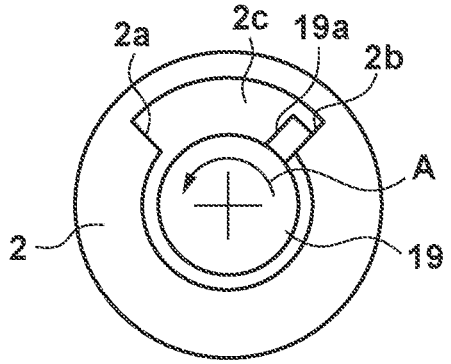

FIG. 5A and FIG. 5B are views illustrating a configuration of a pick-up roller 2. As described above, the pick-up roller 2 comes into contact with the uppermost printing sheet stacked in the feeding tray 11 and picks up the printing sheet. Reference numeral 19 is a drive shaft for transmitting the drive of the feed motor, described later, to the pick-up roller 2. When the printing sheet is picked up, the drive shaft 19 and the pick-up roller 2 rotate in the direction of arrow A in the drawing. A projection 19*a* is provided on the drive shaft 19. A concave portion 2*c*, in which the projection 19*c* is fitted, is formed on the pick-up roller 2. As illustrated in FIG. 5A, in a case where the projection 19*a* is in contact with a first surface 2*a* of the concave portion 2*c* of the pick-up roller 2, the drive of the drive shaft 19 is transmitted to the pick-up roller 2, and the pick-up roller 2 is also rotated when the drive shaft 19 is driven. On the other hand, as illustrated in FIG. 5B, in a case where the projection 19*a* is in contact with a second surface 2*a* of the concave portion 2*c* of the pick-up roller 2, the drive of the drive shaft 19 is not transmitted to the pick-up roller 2, and the pick-up roller 2 is not rotated when the drive shaft 19 is driven. Even in a case where the projection 19*a* does not abut either of the first surface 2*a* and a second surface 2*b* and is located between the first surface 2*a* and the second surface 2*b*, the pick-up roller 2 is not rotated even if the drive shaft 19 is driven.

Figure 6:
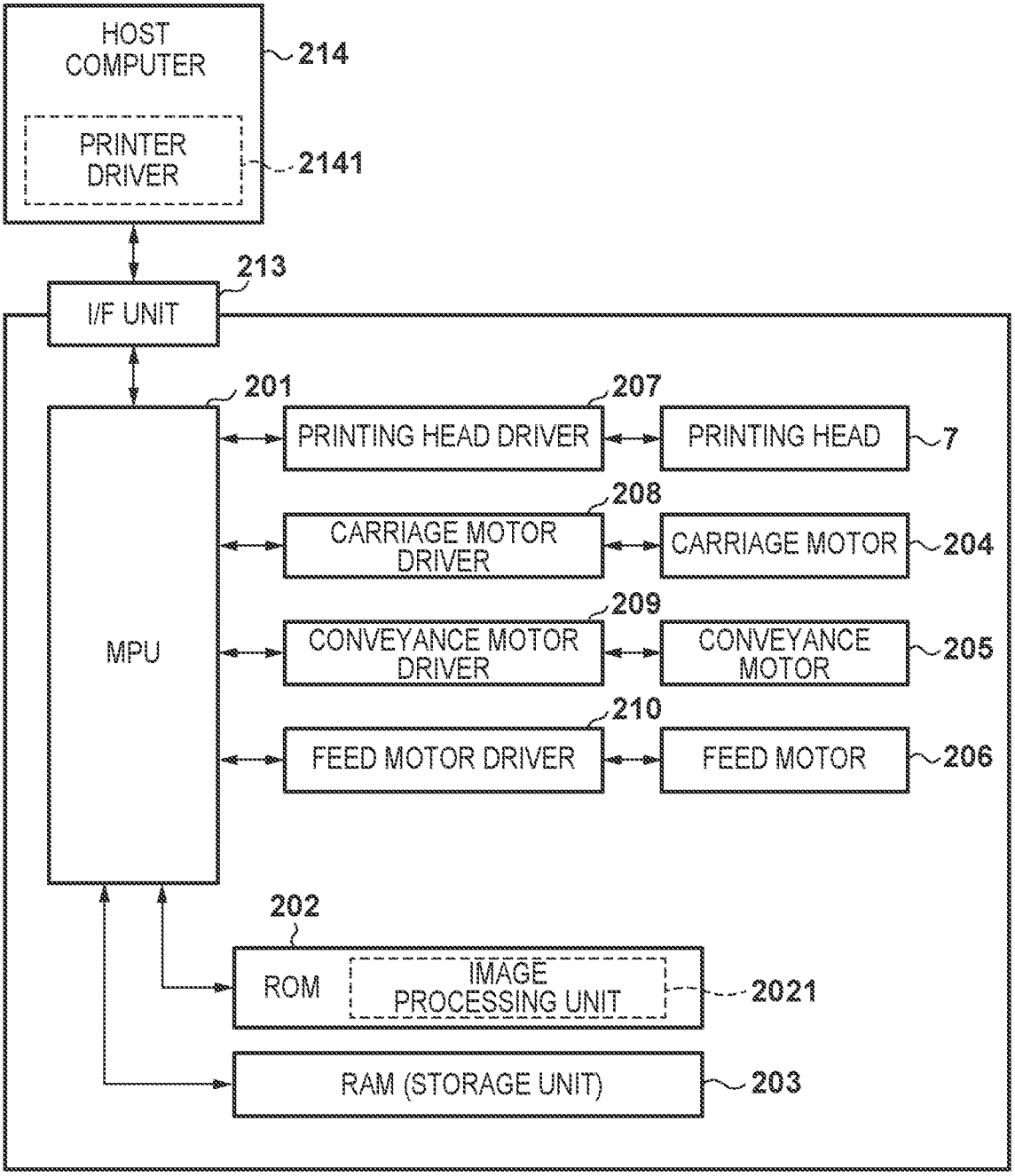
FIG. 6 is a block diagram of the printing apparatus of the embodiment.

FIG. 6 is a block diagram of the printing apparatus of the embodiment. Reference numeral 201 denotes an MPU that controls operations of each unit, processing of data, and the like. As described later, the MPU 201 also functions as a conveyance control unit that can control the conveyance of the printing sheet so that the trailing edge portion of the preceding printing sheet overlaps the leading edge portion of the succeeding sheet. Reference numeral 202 is a ROM for storing programs and data to be executed by the MPU 201. Reference numeral 203 is a RAM for temporarily storing processing data executed by the MPU 201 and data received from a host computer 214.

The printing head 7 is controlled by a printing head driver 207. A carriage motor 204 for driving the carriage 10 is controlled by a carriage motor driver 208. The conveyance roller 5 and the discharge roller 9 are driven by a conveyance motor 205. The conveyance motor 205 is controlled by a conveyance motor driver 209. The pick-up roller 2 and the feeding roller 3 are driven by the feed motor 206. The feed motor 206 is controlled by a feeding motor driver 210.

The carriage motor 204, the conveyance motor 205, and the feed motor 206 are DC motors. These motors are driven by PWM control. The PWM signal output to each driver is expressed by a duty value (ratio of the high level to the low level and the ratio of on and off). The duty value ranges from 0% to 100%. The larger the duty value, the greater the power supplied to the motor.

Here, in the present embodiment, in order to suppress a temperature rise of the conveyance motor 205, the conveyance motor 205 determines whether or not it is in a temperature rising state. The temperature rising state of the conveyance motor 205 is determined from information of a PWM value when the conveyance motor 205 is driven in the printing operation (described later). Specifically, the number of times when the PWM value during driving the conveyance motor 205 exceeds the threshold value is counted, and a "temperature rising state" is determined if the number of times is greater than or equal to a predetermined number of times and a "non-temperature rising state" is determined if the number of times is less than the predetermined number of times. In a case where the conveyance motor 205 is determined to be in a temperature rising state, the speed of the conveyance motor 205 for the printing operation is switched to a low-speed drive. By this, a temperature rise of the conveyance motor is suppressed. Incidentally, temperature rise determination of the conveyance motor 205 is performed every time the conveyance motor 205 for the printing operation is driven. Note, although the temperature rising state of the motor is determined based on the information of the PWM value, a temperature sensor for detecting the temperature of the motor may be provided separately, and in a case where the temperature information is equal to or greater than a predetermined temperature, this may be determined as a temperature rising state.

A printer driver 2141 for collectively communicating printing information such as a print image and a print image quality with the printing apparatus is arranged in the host computer 214 in a case where a user commands the execution of the printing operation. The MPU 201 executes an exchange of a print image and the like with the host computer 214 through an I/F unit 213.

Figure 4:
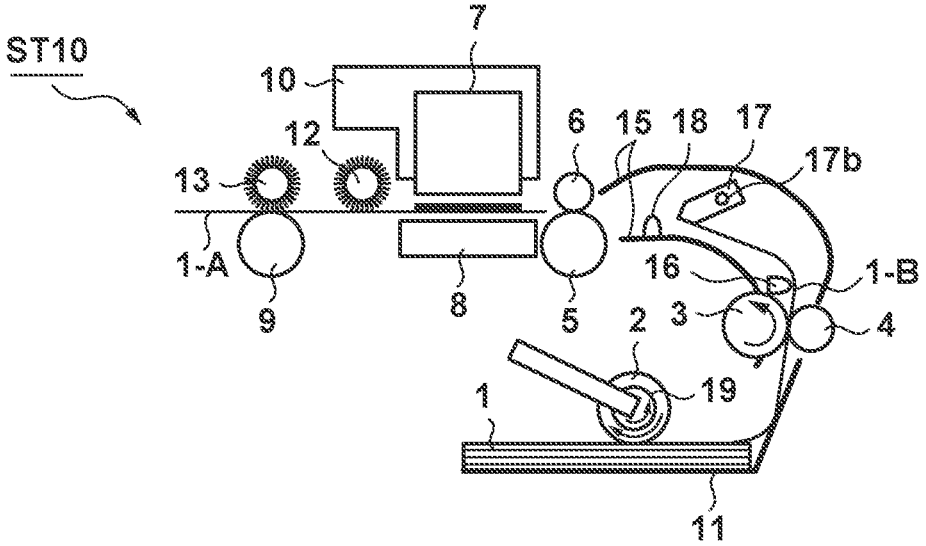
FIG. 4 is a view illustrating an operation of overlapped continuous feeding in a printing apparatus according to an embodiment of the present invention.

By using ST1 of FIG. 1 to ST10 of FIG. 4, operation of the overlapped continuous feeding (operation for overlapping the leading edge of a succeeding sheet on the trailing edge of a preceding sheet and conveying the sheet) is described. When the printing data is transmitted from the host computer 214 through the I/F unit 213, the printing data is processed by the MPU 201 and then loaded into the RAM 203. The MPU 201 starts the printing operation based on the loaded data.

Description is given with reference to ST1 of FIG. 1. First, the feed motor 206 is driven at a low speed by the feed motor driver 210. As a result, the pick-up roller 2 is rotated at 7.6 inch/sec. When the pick-up roller 2 rotates, the uppermost printing sheet (a preceding sheet 1-A) stacked on the feeding tray 11 is picked up. The preceding sheet 1-A picked up by the pick-up roller 2 is conveyed by the feeding roller 3 rotating in the same direction as the pick-up roller 2. The feeding roller 3 is also driven by a feed motor 206. The present embodiment is described with a configuration including the pick-up roller 2 and the feeding roller 3. However, it may be configured to include only a feeding roller for feeding the printing sheets stacked in the stacking unit.

When the leading edge of the preceding sheet 1-A is detected by the first sheet detection sensor 16 provided near the downstream side of the feeding roller 3, the feed motor 206 switches to the high-speed drive. That is, the pick-up roller 2 and the feeding roller 3 rotate at 20 inch/sec.

Description is given with reference to ST2 of FIG. 1. By continuing to rotate the feeding roller 3, the leading edge of the preceding sheet 1-A causes the sheet holding lever 17 to rotate clockwise about the rotation shaft 17*b*, which is against the biasing force of the spring. Furthermore, when the feeding roller 3 is continuously rotated, the leading edge of the preceding sheet 1-A is detected by the second sheet detection sensor 18, and then abuts the conveying nip portion formed by the conveyance roller 5 and the pinch roller 6. At this time the conveyance roller 5 is in a stopped state. The leading edge of the preceding sheet 1-A is aligned in a state in which it abuts the conveying nip portion by the feeding roller 3 being rotated by a predetermined amount based on the first sheet detection sensor 16 even after the leading edge of the preceding sheet 1-A abuts the conveying nip portion, and thereby skew is corrected. The skew correction operation may also be called a registration operation.

Description is given with reference to ST3 of FIG. 1. When the skew correction operation for the preceding sheet 1-A is completed, the conveyance roller 5 starts to rotate by the conveyance motor 205 being driven. The conveyance roller 5 conveys the sheet at 15 inch/sec. After the leading edge of the preceding sheet 1-A is cued to a position facing the printing head 7, the printing operation is performed by ejecting inks from the printing head 7 based on the printing data. Note, the cuing operation is performed by the leading edge of the printing sheet being temporarily aligned at the position of the conveyance roller 5 by abutting the conveying nip portion and then by the rotation amount of the conveyance roller 5 being controlled with reference to the position of the conveyance roller 5.

The printing apparatus of the present embodiment is a serial type printing apparatus in which a printing head 7 is mounted on the carriage 10. A printing operation for a printing sheet is performed by repeating a conveying operation in which the printing sheet is intermittently conveyed by the conveyance roller 5 by intermittently driving the conveyance motor 205 by a predetermined amount and an image forming operation in which ink is ejected from the printing head 7 while moving the carriage 10 on which the printing head 7 is mounted when the conveyance roller 5 is stopped. Each time the conveyance motor 205 is driven intermittently, it performs a determination as to whether the temperature of the conveyance motor 205 has risen. In a case where the conveyance motor 205 is determined to be in a temperature rising state, the conveyance motor 205 switches from the next drive to the low-speed drive, and conveys the sheet at 10 inches/sec.

When the preceding sheet 1-A is cued, the feed motor 206 switches to the low-speed drive. That is, the pick-up roller 2 and the feeding roller 3 rotate at 7.6 inch/sec. When the printing sheets are intermittently conveyed per a predetermined amount by the conveyance roller 5, the feeding roller 3 is also intermittently driven by the feed motor 206. Specifically, the feeding roller 3 is also rotated when the conveyance roller 5 is rotating, and the feeding roller 3 is also stopped when the conveyance roller 5 is stopped. With respect to the rotation speed of the conveyance roller 5, the rotation speed of the feeding roller 3 is small. Therefore, the sheet is pulled between the conveyance roller 5 and the feeding roller 3. Further, the feeding roller 3 is rotated by the printing sheet conveyed by the conveyance roller 5.

In order to drive the feed motor 206 intermittently, the drive shaft 19 is also driven. As described above, the rotation speed of the pick-up roller 2 is smaller than the rotation speed of the conveyance roller 5. For this reason, the pick-up roller 2 is caused to be rotated by the printing sheet conveyed by the conveyance roller 5. That is, the pick-up roller 2 rotates ahead with respect to the drive shaft 19. Specifically, the projection 19*a* of the drive shaft 19 is separated from the first surface 2*a* and contacts the second surface 2*b*. As a result, even if the trailing edge of the preceding sheet 1-A passes through the pick-up roller 2, the second printing sheet (the succeeding sheet 1-B) is not immediately picked up. When the drive shaft 19 is driven for a predetermined time, the projection 19*a* comes in contact with the first surface 2*a*, and the pick-up roller 2 starts to rotate.

Figure 2:
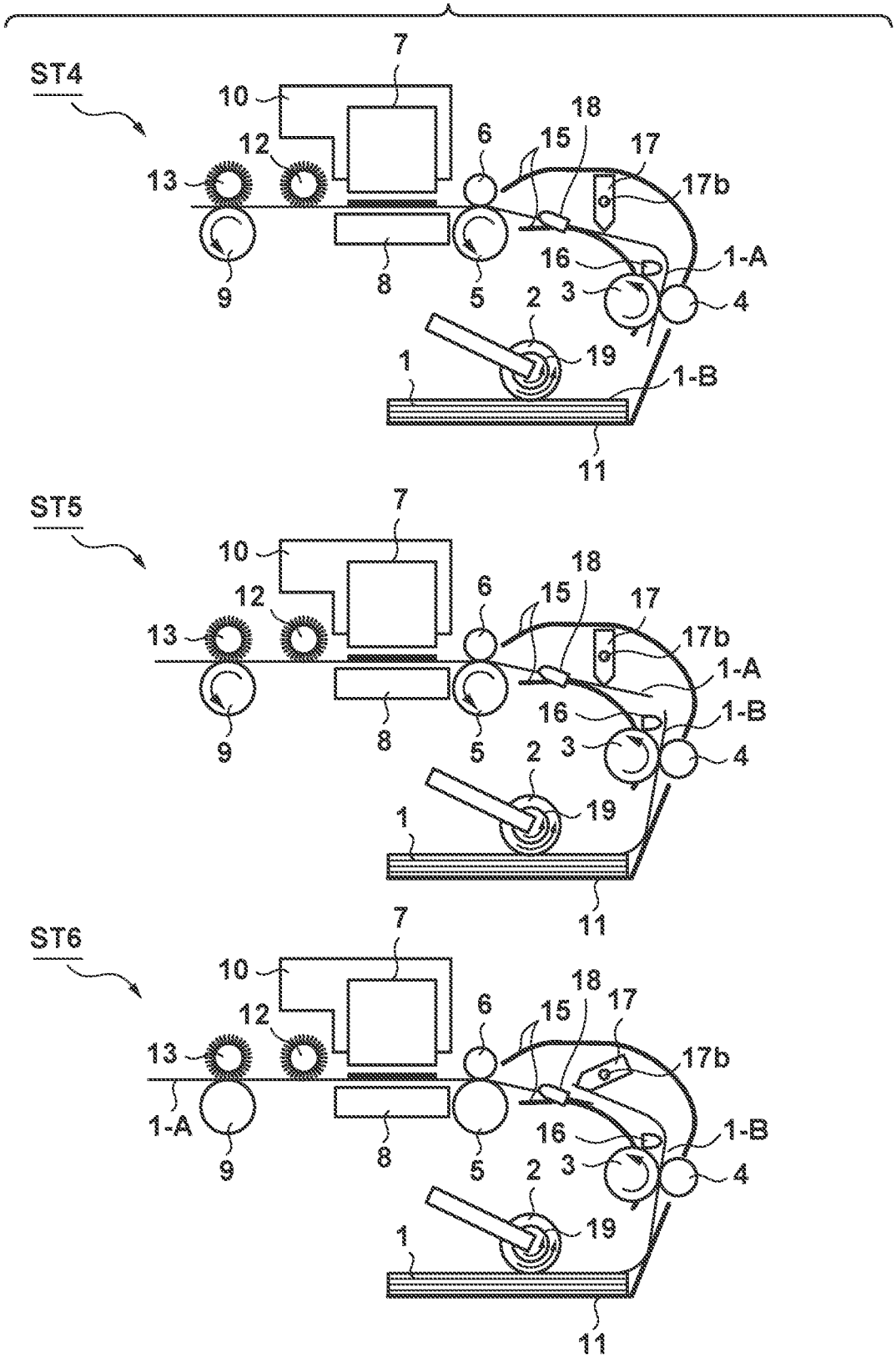
FIG. 2 is a view illustrating an operation of overlapped continuous feeding in a printing apparatus according to an embodiment of the present invention.

Description is given with reference to ST4 of FIG. 2. A state in which the pickup roller 2 has started to rotate and has picked up the succeeding sheet 1-B is illustrated. The first sheet detection sensor 16 requires a predetermined interval or more between the sheets in order to detect the leading edge of the printing sheet due to factors such as the response of the sensor. That is, a predetermined distance between the trailing edge portion of the preceding sheet 1-A and the leading edge portion of the succeeding sheet 1-B is required in order to provide a predetermined time interval before detecting the leading edge of the succeeding sheet 1-B after the trailing edge of the preceding sheet 1-A is detected by the first sheet detection sensor 16. Therefore, the concave portion 2*c* of the pick-up roller 2 is set to about 70 degrees.

Description is given with reference to ST5 of FIG. 2. The succeeding sheet 1-B picked up by the pick-up roller 2 is conveyed by the feeding roller 3. At this time, for the preceding sheet 1-A, an image forming operation is performed by the printing head 7 based on the printing data. When the leading edge of the succeeding sheet 1-B is detected by the first sheet detection sensor 16, the speed of the feed motor 206 switches in accordance with the temperature rising state of the conveyance motor 205 in the present embodiment.

Here, in the present embodiment, in a case where the conveyance motor 205 is in a temperature rising state, in order to suppress the temperature rise of the conveyance motor 205, the rotational speed of the conveyance motor 205 is reduced and also the overlapped continuous feeding operation is not performed. That is, the operation of overlapping the leading edge of the succeeding sheet 1-B on the trailing edge of the preceding sheet 1-A is not performed. Specifically, the conveyance motor 205 switches from a normal conveyance speed of 15 inches/sec to a conveyance speed of 10 inches/sec, which is a low-speed drive. Also, the speed of the feed motor 206 is driven in synchronism with the conveyance motor 205 without changing the low-speed drive (7.6 inch/sec). Since the rotation speed of the conveyance motor 205 is higher than the rotation speed of the feed motor 206, and the conveyance motor 205 and the feed motor 206 are synchronously driven, the succeeding sheet 1-B does not catch up with the preceding sheet 1-A, and an overlapping state is not formed.

ST10 of FIG. 4 shows a state in which the printing operation on the preceding sheet 1-A is completed. Since the trailing edge of the preceding sheet 1-A and the leading edge of the succeeding sheet 1-B do not overlap with each other due to the driving of the motor as described above, the leading edge of the succeeding sheet 1-B can be detected by the second sheet detection sensor 18. In other words, the leading edge position of the succeeding sheet 1-B can be calculated from the rotational amount of the feeding roller 3 based on the position of the second sheet detection sensor 18 rather than the position of the first sheet detection sensor 16. Therefore, the skew correction operation for the succeeding sheet 1-B can be performed by driving the feeding roller 3 by the skew correction conveyance amount with reference to the second sheet detection sensor 18, and the skew correction operation can be performed accurately. Since the second sheet detection sensor 18 is closer to the conveying nip portion of the conveyance roller 5 than the first sheet detection sensor 16, if the position (detection result) is used as a reference, the leading edge position of the succeeding sheet 1-B can be controlled more accurately than if the position of the first sheet detection sensor 16 is used as a reference.

On the other hand, in a case where the conveyance motor is not in a temperature rising state, the feed motor 206 switches to the high-speed drive, the overlapped continuous feeding operation is performed. That is, the pick-up roller 2 and the feeding roller 3 rotate at 20 inch/sec.

Description is given with reference to ST6 of FIG. 2. The trailing edge portion of the preceding sheet 1-A is pressed downward by the sheet holding lever 17 as illustrated in ST5 of FIG. 2 and the preceding sheet 1-A is detected by the second sheet detection sensor 18. Since the printing operation is being performed on the preceding sheet 1-A based on the printing data, the preceding sheet 1-A is intermittently conveyed by the conveyance roller 5 at a normal rotational speed of 15 inches/sec. On the other hand, since the feeding roller 3 is consecutively driven at a high speed to convey the succeeding sheet 1-B, the distance between the trailing edge of the preceding sheet 1-A and the leading edge of the succeeding sheet 1-B becomes smaller. If the conveyance motor remains in the non-temperature rising state, it is possible to form a state in which the trailing edge portion of the succeeding sheet 1-B overlaps the leading edge portion of the preceding sheet 1-A (ST6 of FIG. 2) due to the continuous driving of the feeding roller 3.

Even during high-speed driving of the feeding roller 3, the conveyance motor 205 is intermittently driven for the printing operation, and the temperature rise determination is performed every time a drive is performed. In a case where the conveyance motor 205 is in the temperature rising state, if the rotation amount of the feeding roller 3 after starting the high-speed driving is shorter than the distance between the first sheet detection sensor 16 and the second sheet detection sensor 18, the driving of the feeding roller 3 is stopped to stop the overlapped continuous feeding operation. Also, in this instance, when the printing operation for the preceding sheet 1-A is completed, the state is as illustrated in ST10 of FIG. 4.

In this way, the leading edge of the succeeding sheet 1-B can be detected by the second sheet detection sensor 18 by not overlapping the trailing edge of the preceding sheet 1-A and the leading edge of the succeeding sheet 1-B. Therefore, as already described, by driving the feeding roller 3 by the skew correction conveying amount with the second sheet detection sensor 18 as a reference, it is possible to accurately perform the skew correction operation for the succeeding sheet 1-B.

Figure 3:
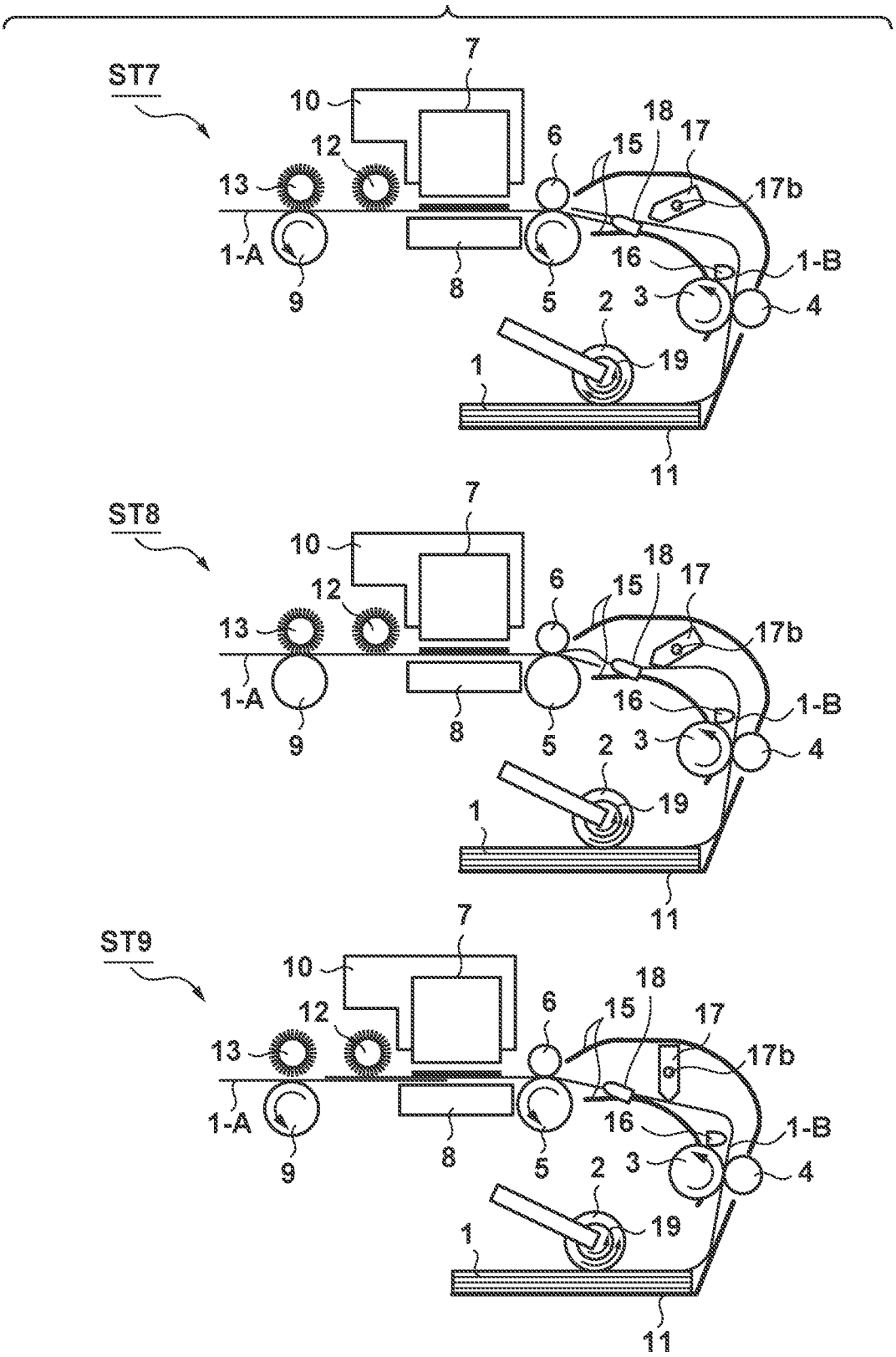
FIG. 3 is a view illustrating an operation of overlapped continuous feeding in a printing apparatus according to an embodiment of the present invention.

Description is given with reference to ST7 of FIG. 3. After forming an overlapping state in which the leading edge portion of the succeeding sheet 1-B overlaps the trailing edge portion of the preceding sheet 1-A, the succeeding sheet 1-B is conveyed by the feeding roller 3 until the leading edge stops at a predetermined position upstream of the conveying nip. When the overlapping state is formed, it is impossible to detect the leading edge of the succeeding sheet 1-B by the second sheet detection sensor 18 since the second sheet detection sensor 18 detects the preceding sheet 1-A. Therefore, the position of the leading edge of the succeeding sheet 1-B is calculated from the rotational amount of the feeding roller 3 after the leading edge of the succeeding sheet 1-B is detected by the first sheet detection sensor 16, and is controlled based on the calculation result. At this time, for the preceding sheet 1-A, an image forming operation is performed by the printing head 7 based on the printing data.

Description is given with reference to ST8 of FIG. 3. When the conveyance roller 5 is stopped in order to perform an image forming operation (ink ejection operation) of the last line of the preceding sheet 1-A, the leading edge of the succeeding sheet 1-B abuts the conveying nip portion by the feeding roller 3 being driven, and the skew correction operation for the succeeding sheet 1-B is performed. At this time, as already described, since the second sheet detection sensor 18 is detecting the preceding sheet 1-A, it is impossible to detect the leading edge of the succeeding sheet 1-B. Therefore, the driving amount of the feed motor 206 for skew correction operation of the succeeding sheet 1-B becomes a predetermined amount based on the first sheet detection sensor 16.

Description is given with reference to ST9 of FIG. 3. When the image forming operation of the last line of the preceding sheet 1-A is completed, it is possible to cue the succeeding sheet 1-B while maintaining a state in which the succeeding sheet 1-B overlaps the preceding sheet 1-A by rotating the conveyance roller 5 by a predetermined amount. The printing operation is performed on the succeeding sheet 1-B by the printing head 7 based on printing data. When the succeeding sheet 1-B is intermittently conveyed for the printing operation, the preceding sheet 1-A is also intermittently conveyed, and eventually, the preceding sheet 1-A is discharged to the outside of the printing apparatus by the discharge roller 9.

Incidentally, when the succeeding sheet 1-B is cued, in preparation for the printing operation for the succeeding sheet 1-B, the feed motor 206 switches to the low-speed drive. That is, the pick-up roller 2 and the feeding roller 3 rotate at 7.6 inch/sec. In a case where there is printing data even after the succeeding sheet 1-B, ST4 of FIG. 2 is returned to and a third pick-up operation is performed.

FIG. 7A to FIG. 7E are flowcharts of an overlapped continuous feeding operation in the embodiment. In step S1, when the printing data is transmitted from the host computer 214 through the I/F unit 213, the printing operation is started. In step S2, the feeding operation of the preceding sheet 1-A is started. Specifically, the feed motor 206 is driven at a low speed. That is, the pick-up roller 2 and the feeding roller 3 rotate at 7.6 inch/sec. The preceding sheet 1-A is picked up by the pick-up roller 2, and the preceding sheet 1-A is fed toward the printing head 7 by the feeding roller 3.

In step S3, the leading edge of the preceding sheet 1-A is detected by the first sheet detection sensor 16. When the leading edge of the preceding sheet 1-A is detected by the first sheet detection sensor 16, the feed motor 206 switches to the high-speed drive in step S4. That is, the pick-up roller 2 and the feeding roller 3 rotate at 20 inch/sec. After this, the leading edge of the preceding sheet 1-A is detected by the second sheet detection sensor 18. After the leading edge of the preceding sheet 1-A is detected by the second sheet detection sensor 18, the leading edge position of the preceding sheet 1-A is controlled by the rotation amount of the feeding roller 3 with reference to the position of the second sheet detection sensor 18. In step S5, by controlling the leading edge position, the leading edge of the preceding sheet 1-A is abutted against the conveying nip portion and the skew correction operation for the preceding sheet 1-A is performed.

In step S6, the preceding sheet 1-A is cued based on the printing data. That is, by controlling the rotational amount of the conveyance roller 5, the preceding sheet 1-A is conveyed to the printing start position with reference to the position of the conveyance roller 5 based on the printing data. The feed motor 206 switches to the low-speed drive (7.6 inch/sec) in step S7. In step S8, the printing operation is started by ejecting the ink from the printing head 7 to the preceding sheet 1-A. Specifically, a conveying operation in which the preceding sheet 1-A is intermittently conveyed at a conveying speed of 15 inches/sec, which is a normal speed, by the conveyance roller 5, and an image forming operation (ink ejection operation) in which the carriage 10 is moved to eject ink from the printing head 7 are repeated. As a result, the printing operation for the preceding sheet 1-A is performed. The feed motor 206 is driven at a low speed intermittently in synchronization with the operation of intermittently conveying the preceding sheet 1-A by the conveyance roller 5. That is, the pick-up roller 2 and the feeding roller 3 intermittently rotate at 7.6 inch/sec.

In step S9, it is determined whether or not there is printing data for the next page. If there is no printing data for the next page, the process proceeds to step S28. When the printing operation on the preceding sheet 1-A is completed in step S28, the preceding sheet 1-A is discharged and the printing operation is terminated in step S29.

If there is printing data for the next page in step S9, the feeding operation of the succeeding sheet 1-B is started in step S10. Specifically, the succeeding sheet 1-B is picked up by the pick-up roller 2, and the succeeding sheet 1-B is fed toward the printing head 7 by the feeding roller 3. That is, the pick-up roller 2 and the feeding roller 3 rotate at 7.6 inch/sec. As described above, since the concave portion 2*c* of the pick-up roller 2 is arranged to be large with respect to the projection 19*a* of the drive shaft 19, the succeeding sheet 1-B is fed with a predetermined distance from the trailing edge of the preceding sheet 1-A.

In step S11, the printing operation on the preceding sheet 1-A is continued by the printing head 7.

In step S12, when the leading edge of the succeeding sheet 1-B is detected by the first sheet detection sensor 16, the temperature rising state of the conveyance motor 205 is determined in step S13, and the driving method of the feed motor 206 is switched. If the conveyance motor 205 is not in the temperature rising state, the overlapped continuous feeding operation is continued and the feed motor 206 switches to the high-speed drive in step S14. That is, the pick-up roller 2 and the feeding roller 3 rotate at 20 inch/sec. The preceding sheet 1-A is intermittently conveyed at a rate of 15 inches/sec based on the printing data, and the printing is continued. Each time the conveyance motor 205 is driven intermittently, temperature rise determination is performed.

It is determined whether to continue the overlapped continuous feeding operation from the temperature rising state of the conveyance motor 205 and the rotation amount of the feeding roller 3 in step S15. In a case where, in the middle of the high-speed driving of the feeding roller, the conveyance motor 205 is determined to be in the temperature rising state, if the rotation amount of the feeding roller 3 after the start of the high-speed driving is shorter than the distance between the first sheet detection sensor 16 and the second sheet detection sensor 18, the overlapped continuous feeding operation stops and the processing advances to step S39. Otherwise, the overlapped continuous feeding operation is continued and the processing advances to step S16.

In step S16, by controlling the rotational amount of the feeding roller 3 after the leading edge of the succeeding sheet 1-B is detected by the first sheet detection sensor 16, the succeeding sheet 1-B is conveyed so that the leading edge of the succeeding sheet 1-B is positioned in front of the conveying nip portion by a predetermined amount. The preceding sheet 1-A is intermittently conveyed at a rate of 15 inches/sec based on the printing data. The succeeding sheet 1-B is continuously driven at a high speed of 20 inches/sec by the feed motor 206 to catch up with the preceding sheet 1-A, and an overlapping state in which the leading edge portion of the succeeding sheet 1-B overlaps the trailing edge portion of the preceding sheet 1-A is formed.

In step S17, it is determined whether a predetermined condition (described later) is satisfied. In a case where the predetermined condition is satisfied, it is determined in step S18 whether the image forming operation of the last line of the preceding sheet 1-A is started. In a case where the image forming operation of the last line is started, the processing advances to step S19, and when it is not started, the processing waits until it is started. In step S19, the leading edge of the succeeding sheet 1-B is abutted against the conveying nip portion while maintaining the overlapping state and the skew correction operation for the succeeding sheet 1-B is performed. In a case where it is determined in step S20 that the image forming operation of the last line of the preceding sheet 1-A is completed, the succeeding sheet 1-B is cued while maintaining the overlapping state in step S21.

In a case where the predetermined condition is not satisfied in step S17, the overlapping state is cancelled and the succeeding sheet 1-B is cued. Specifically, when the image forming operation of the last line of the preceding sheet 1-A is completed in step S30, a discharging operation of the preceding sheet 1-A is performed in step S31. During this time, since the feed motor 206 is not driven, the succeeding sheet 1-B is stopped while the leading edge thereof is in a position in front of the conveying nip portion by a predetermined amount. Since the preceding sheet 1-A is discharged, the overlapping state is released. In step S32, the leading edge of the succeeding sheet 1-B is abutted against the conveying nip portion and the skew correction operation for the succeeding sheet 1-B is performed. Then, in step S21, the succeeding sheet 1-B is cued.

The feed motor 206 switches to the low-speed drive in step S22. That is, the pick-up roller 2 and the feeding roller 3 rotate at 7.6 inch/sec.

Meanwhile, if the conveyance motor 205 in step S13 was in the temperature rising state, the processing would advance to step S33 without performing the overlapped continuous feeding operation. The conveyance motor 205 switches to a conveying speed of 10 inch/sec, which is a low-speed drive, and the speed of the feed motor 206 is left unchanged at low-speed drive (7.6 inch/sec), and the feed motor 206 is driven in synchronism with the conveyance motor 205. After the printing operation on the preceding sheet 1-A is completed in step S34, the preceding sheet 1-A is discharged in step S35.

If it is determined in step S15 that the overlapped continuous feeding operation is to be stopped, the processing advances to step S39. In step S39, the printing operation of the preceding sheet 1-A is continued by switching the conveyance motor 205 to the low-speed drive (10 inch/sec). At the same time, the feed motor 206 is stopped to stop the conveyance of the succeeding sheet 1-B. After the printing operation on the preceding sheet 1-A is completed in step S40, the preceding sheet 1-A is discharged in step S41.

In step S36, the leading edge of the succeeding sheet 1-B is abutted against the conveying nip portion and the skew correction operation for the succeeding sheet 1-B is performed. At this time, the leading edge of the succeeding sheet 1-B can be detected by the second sheet detection sensor 18 since the trailing edge of the preceding sheet 1-A and the leading edge of the succeeding sheet 1-B are not overlapping. Therefore, by driving the feed motor 206 only the skew correction conveying amount with reference to the second sheet detection sensor 18, the skew correction operation for the succeeding sheet 1-B is performed. Then, in step S37, the succeeding sheet 1-B is cued.

In step S23, the printing operation is started by ejecting the ink from the printing head 7 to the succeeding sheet 1-B. Specifically, the printing operation for the succeeding sheet 1-B is performed by repeating the conveyance operation for intermittently conveying the succeeding sheet 1-B by the conveyance roller 5 and the image forming operation (ink ejection operation) of causing the carriage 10 to move and ejecting ink from the printing head 7. The feed motor 206 is driven at a low speed intermittently in synchronization with the operation of intermittently conveying the succeeding sheet 1-B by the conveyance roller 5 at a speed of 15 inch/sec. That is, the pick-up roller 2 and the feeding roller 3 intermittently rotate at 7.6 inch/sec.

In step S24, it is determined whether or not there is printing data for the next page. If there is no printing data for the next page, the process returns to step S10. In a case where there is no printing data of the next page, when the image forming operation of the succeeding sheet 1-B is completed in step S25, the discharging operation of the succeeding sheet 1-B is performed in step S26, and the printing operation is completed in step S27.

Figure 7A:
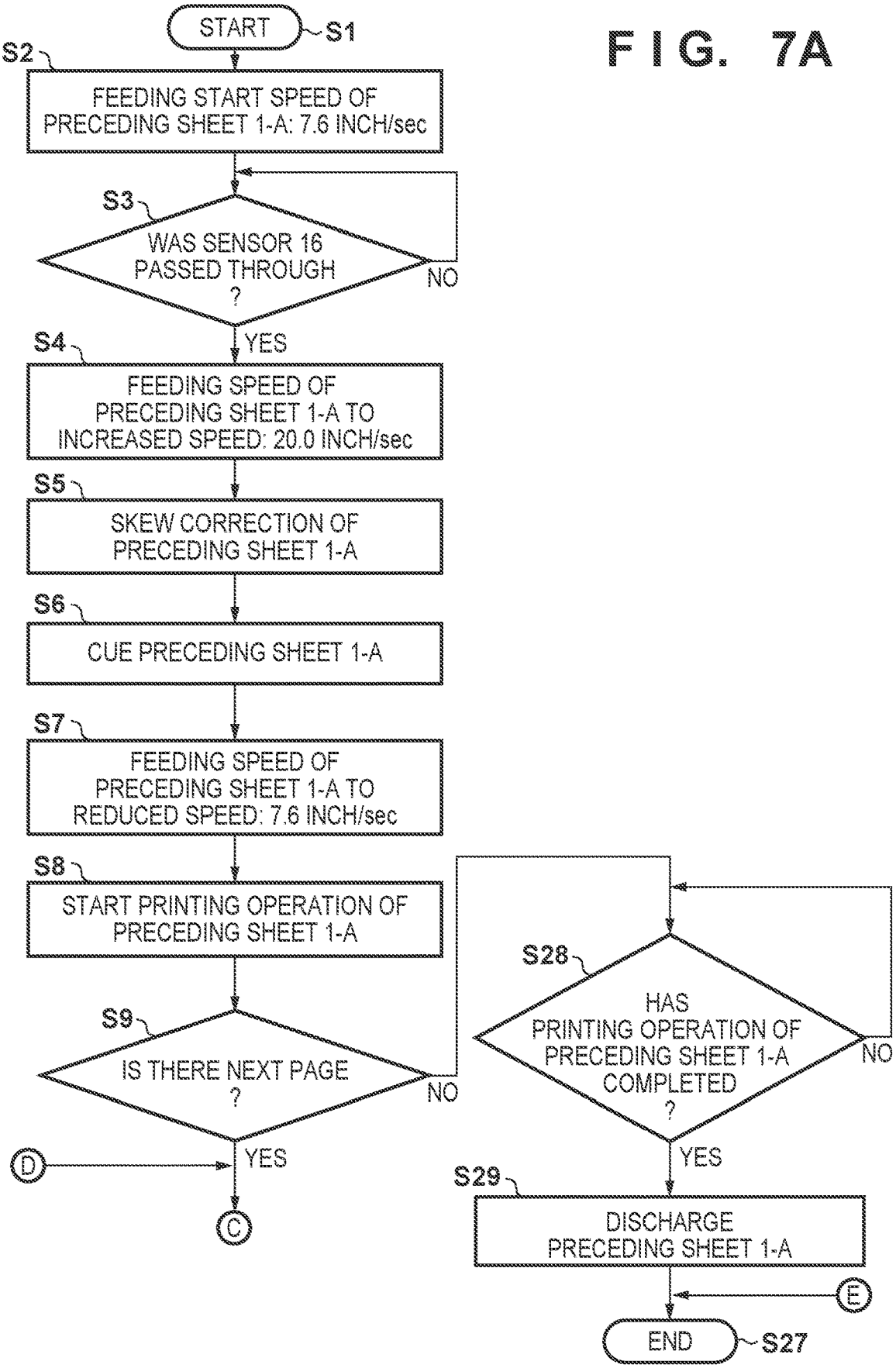
FIG. 7A to FIG. 7E are flow charts of an overlapped continuous feeding operation in the embodiment.
Figure 7B:
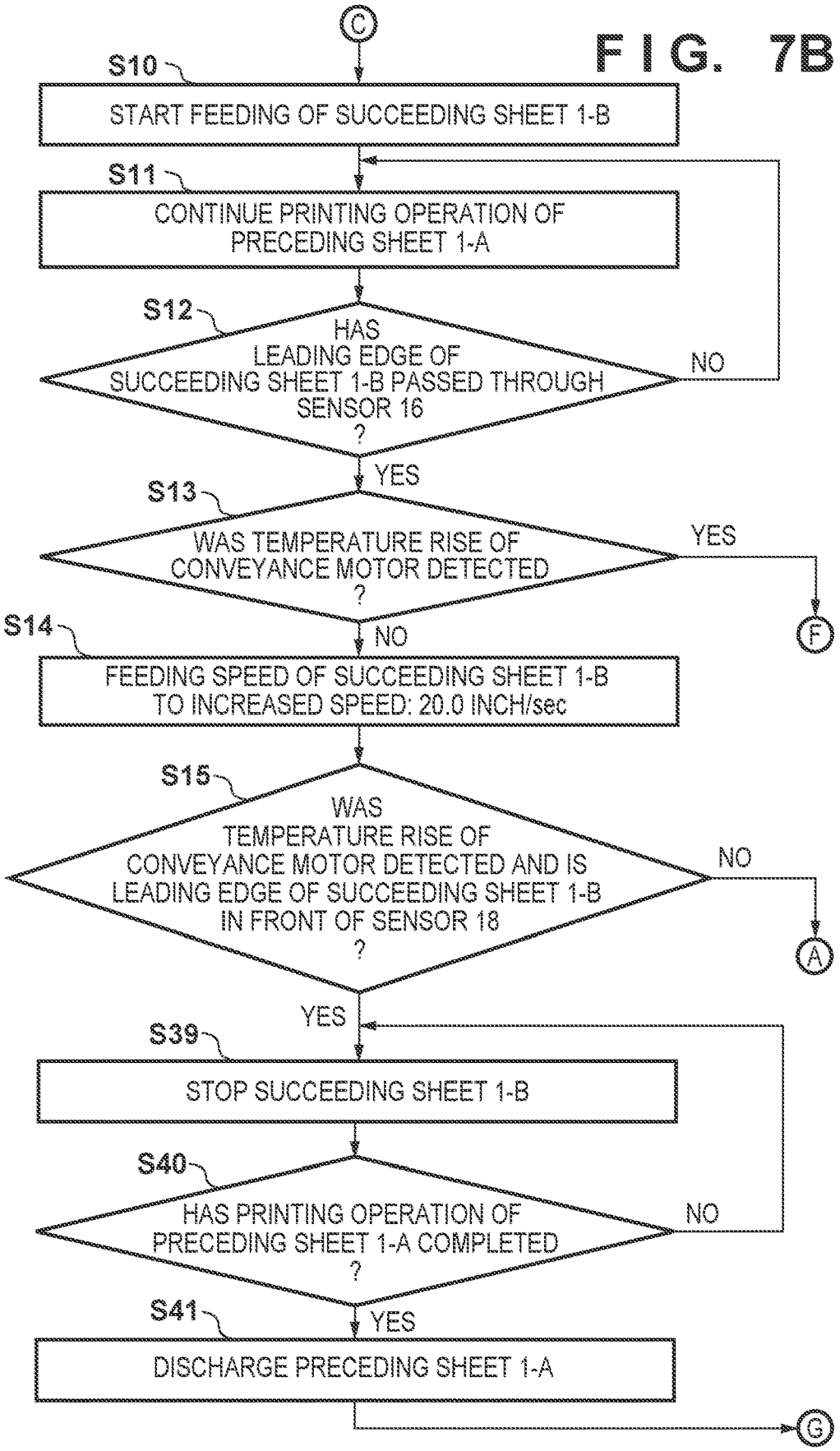
Figure 7C:
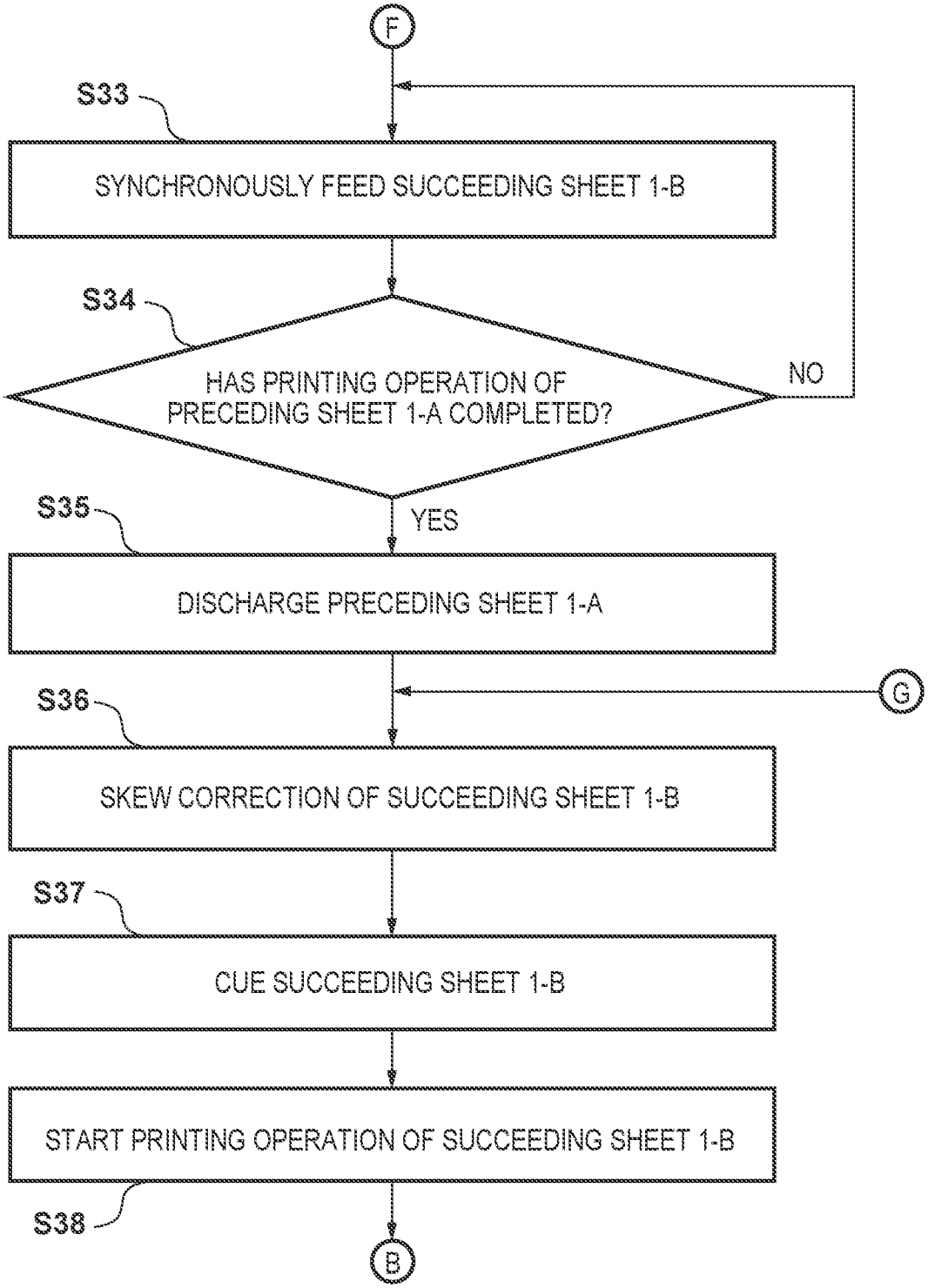
Figure 7D:
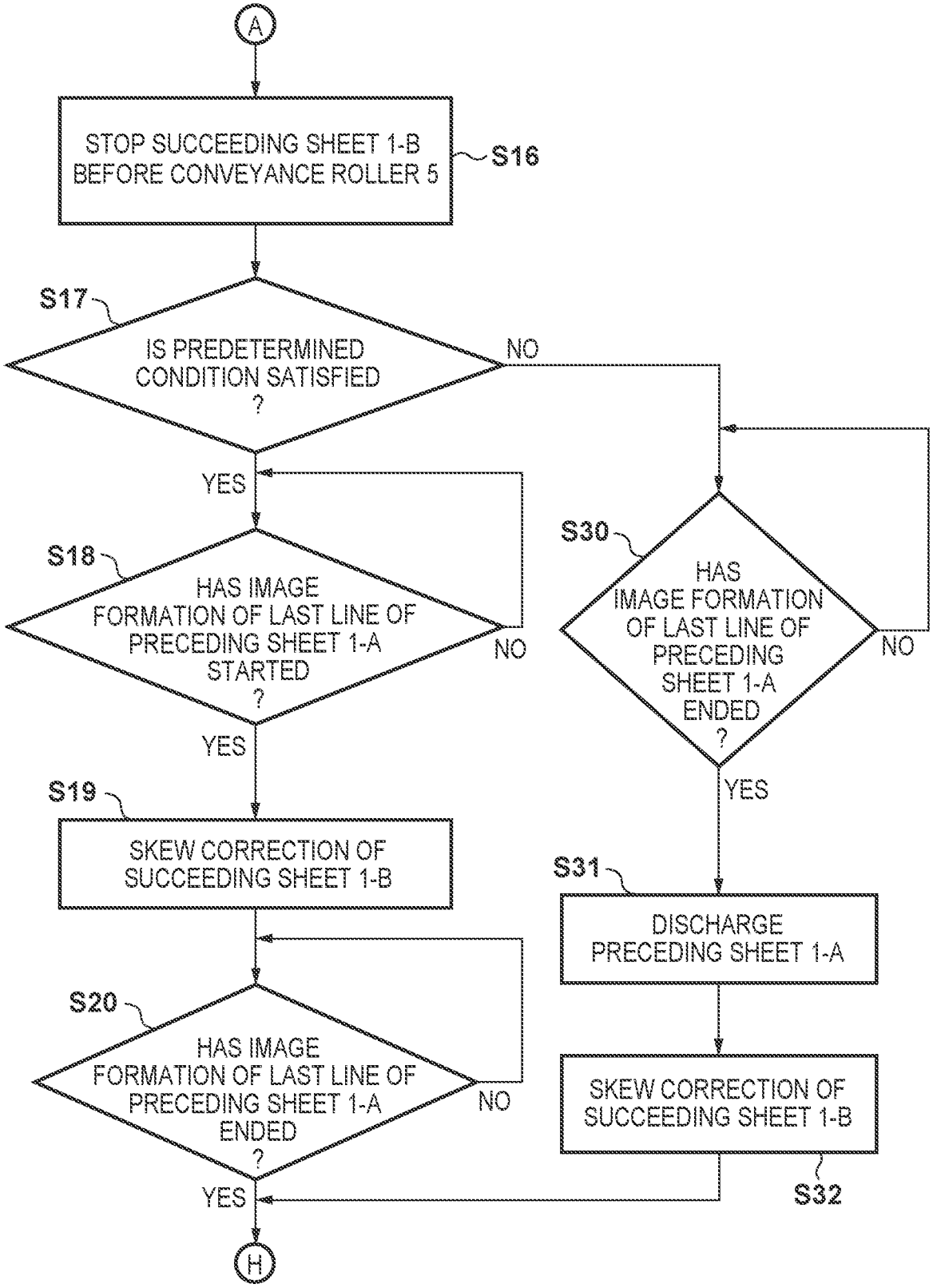
Figure 7E:
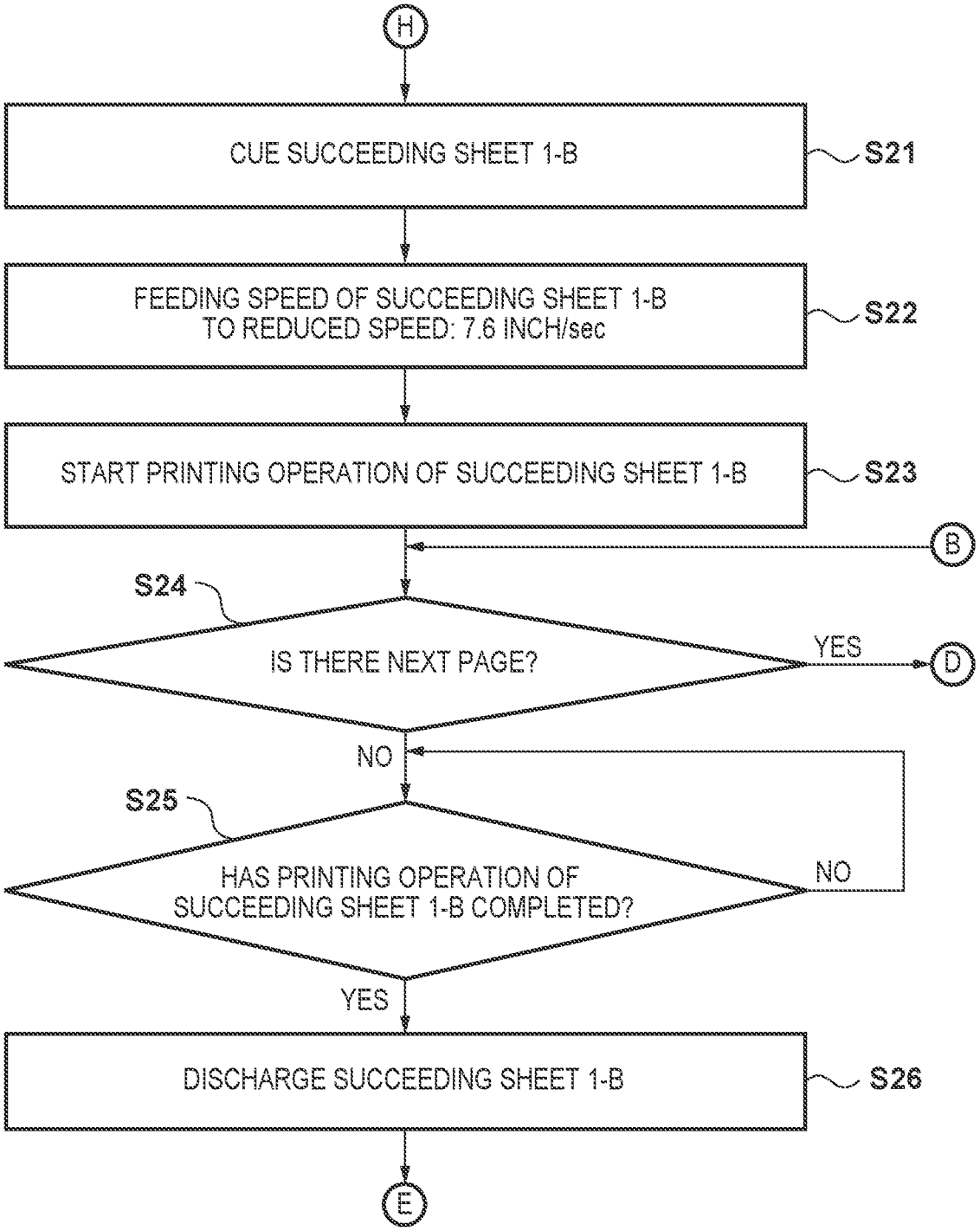
Figure 8:
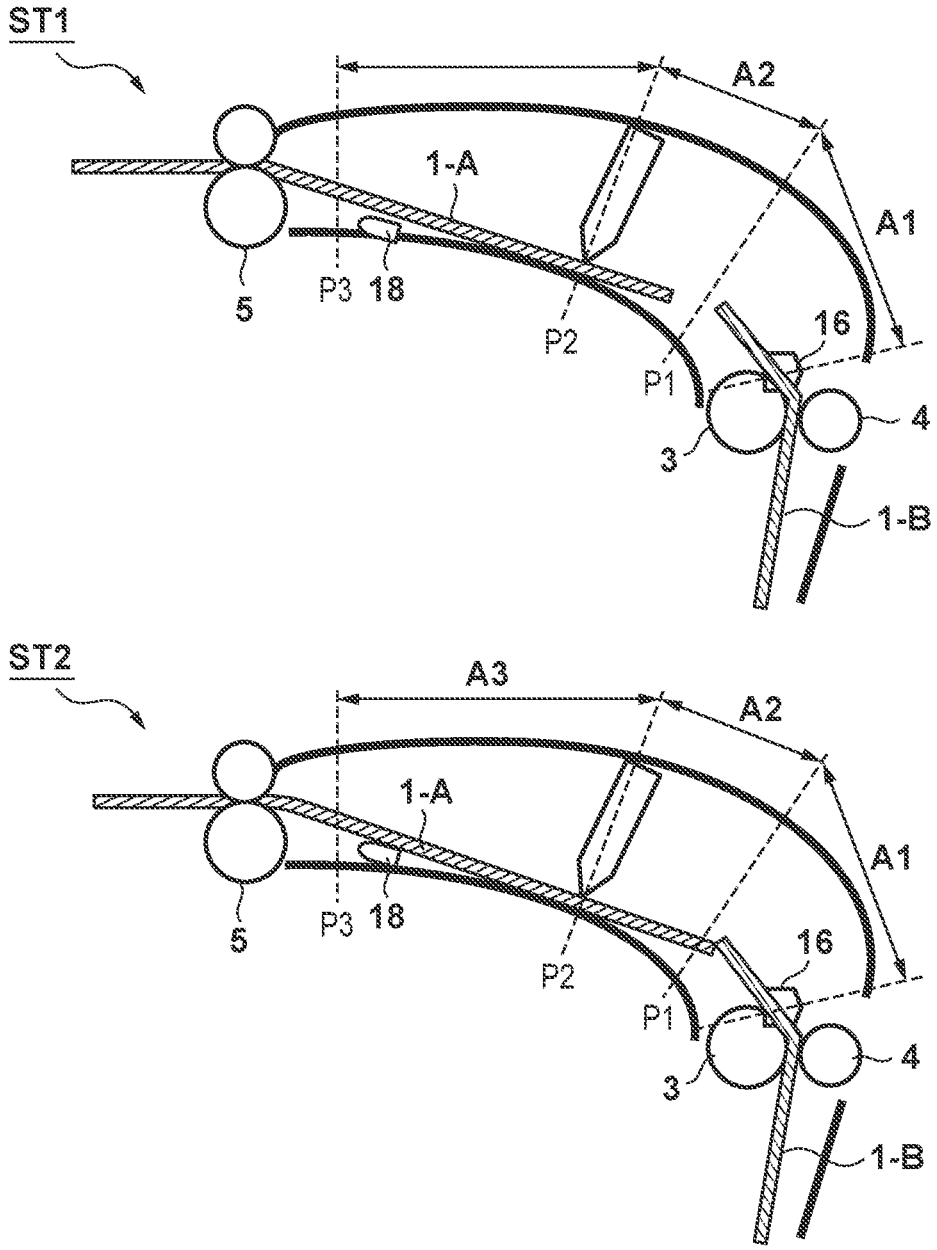
FIG. 8 is a view illustrating an operation of overlapping a succeeding sheet on the preceding sheet.
Figure 9:
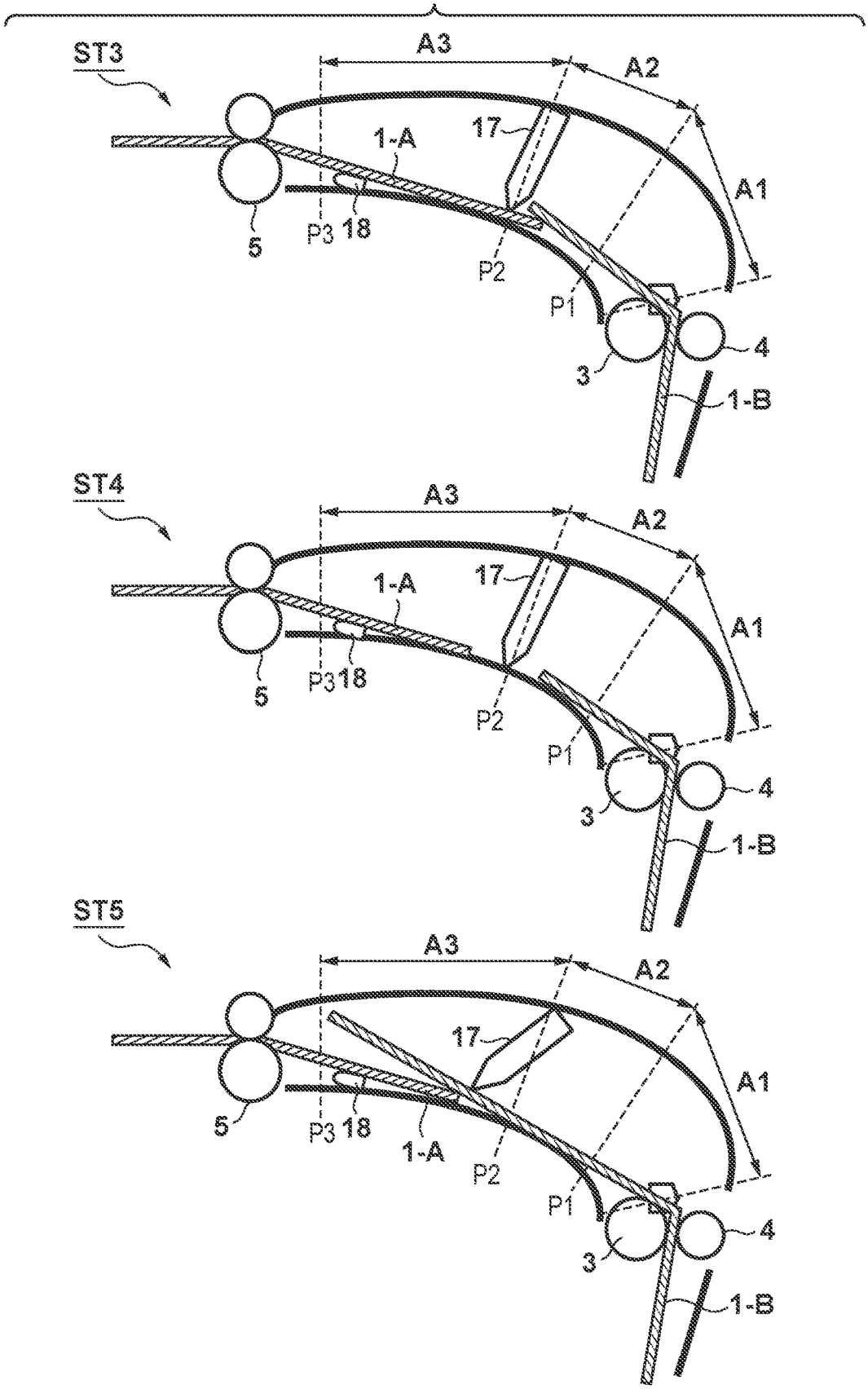
FIG. 9 is a view illustrating an operation of overlapping a succeeding sheet on the preceding sheet.

FIG. 8 and FIG. 9 are views for describing an operation of overlapping a succeeding sheet on a preceding sheet in the present embodiment. Description is given of an operation of forming an overlapping state in which the leading edge portion of the succeeding sheet overlaps the trailing edge portion of the preceding sheet as described in step S16 of FIG. 7D.

FIG. 8 and FIG. 9 are enlarged views of a feeding nip portion formed by the feeding roller 3 and the feeding pinch roller 4 and a conveying nip portion formed by the conveyance roller 5 and the pinch roller 6.

A process in which the printing sheet is conveyed by the conveyance roller 5 and the feeding roller 3 is described in order as three states. With reference to ST1 and ST2 of FIG. 8, a first state in which an operation in which a succeeding sheet follows a preceding sheet will be described. With reference to ST3 and ST4 of FIG. 9, a second state in which an operation in which a succeeding sheet overlaps a preceding sheet will be described. With reference to ST5 of FIG. 9, a third state in which it is determined whether or not the skew correction operation for the succeeding sheet is performed while maintaining the overlapping state is described.

In ST1 of FIG. 8, the feeding roller 3 is controlled to convey the succeeding sheet 1-B, and the leading edge of the succeeding sheet 1-B is detected by the first sheet detection sensor 16. A position P1 at which the succeeding sheet 1-B from the first sheet detection sensor 16 can be overlapped on the preceding sheet 1-A is defined as a first section A1. In the first section A1, an operation in which the leading edge of the succeeding sheet 1-B follows the trailing edge of the preceding sheet 1-A is performed. Specifically, the conveyance control of the succeeding sheet 1-B is performed so that the distance between the trailing edge of the preceding sheet 1-A and the leading edge of the succeeding sheet 1-B becomes 10 mm. P1 is determined by the configuration of the mechanism.

In the first state, in the first section A1, there is a case in which the driving of the feed motor 206 is stopped to stop the conveyance of the succeeding sheet 1-B. That is, there is a case where the following operation is stopped. This prevents the leading edge of the succeeding sheet 1-B from overtaking the trailing edge of the preceding sheet 1-A before P1, as in ST2 of FIG. 8. When the trailing edge of the preceding sheet 1-A and the leading edge of the succeeding sheet 1-B are separated by 10 mm or more after the driving of the feed motor 206 is stopped, the driving of the feed motor 206 is restarted and the conveyance of the succeeding sheet 1-B is restarted. Thus, while the leading edge of the succeeding sheet 1-B is conveyed in the first section A1, the feed motor 206 may repeat driving and stopping.

In ST3 of FIG. 9, the above-described position P1 to the position P2 where the sheet holding lever 17 is provided is defined as a second section A2. In the second section A2, an operation in which the succeeding sheet 1-B is overlapped on the preceding sheet 1-A is performed.

In the second state, in the second section A2, there is a case where the operation of overlapping the succeeding sheet on the preceding sheet is stopped. As in ST4 of FIG. 9, in a case where the leading edge of the succeeding sheet 1-B cannot catch up with the trailing edge of the preceding sheet 1-A in the second section A2, the operation of overlapping the preceding sheet on the succeeding sheet cannot be performed.

In ST5 of FIG. 9, the above-mentioned P2 to P3 are defined as the third section A3. P3 is the position of the leading edge when the succeeding sheet is stopped in step S16 of FIG. 7D. The succeeding sheet 1-B is conveyed while being overlapped on the preceding sheet 1-A until the leading edge of the succeeding sheet 1-B reaches P3. In the third section A3, it is determined whether or not the succeeding sheet 1-B abuts the conveying nip portion and cuing is performed, while maintaining the overlapping state. Specifically, it is determined whether the skew correction operation and cuing is performed by maintaining the overlapping state or whether the skew correction operation and cuing is performed by releasing the overlapping state.

Figure 10:
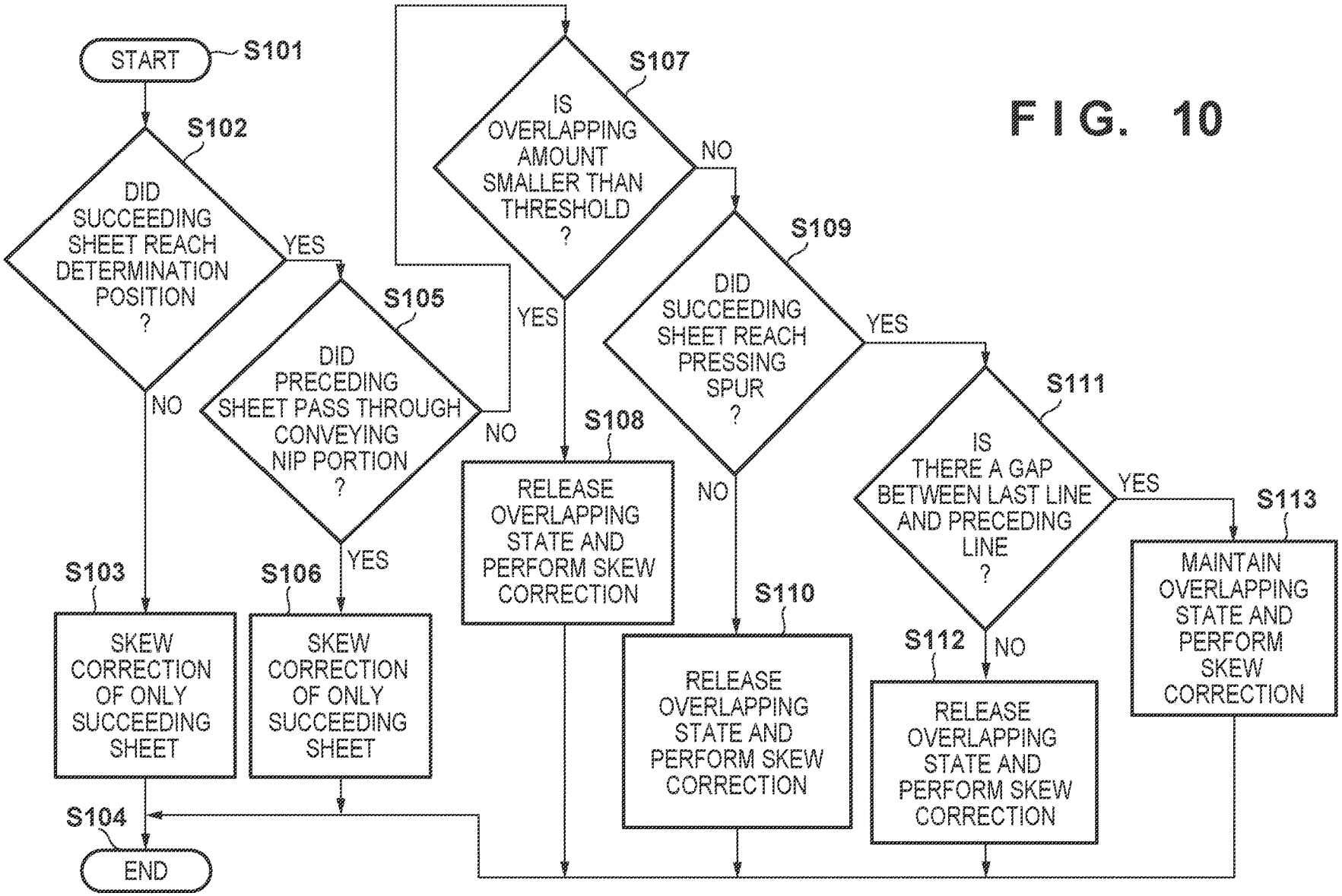
FIG. 10 is a flowchart illustrating a skew correction operation of the succeeding sheet in the embodiment.

FIG. 10 is a flowchart illustrating a skew correction operation of the succeeding sheet in the embodiment. Determination of whether or not the predetermined condition described in step S17 of FIG. 7D is satisfied is described in detail.

An operation of determining whether to perform the skew correction operation by abutting the leading edge of the succeeding sheet 1-B against the conveying nip portion while maintaining the overlapping state of the preceding sheet 1-A and the succeeding sheet 1-B, or to perform the skew correction operation by abutting the leading edge of the succeeding sheet 1-B against the conveying nip portion after releasing the overlapping state of the preceding sheet 1-A and the succeeding sheet 1-B is described.

Processing starts in step S101. In step S102, it is determined whether or not the leading edge of the succeeding sheet 1-B has reached the determination position (P3 of ST5 of FIG. 9). Here, if not reached (step S102: NO), since it is unknown whether the leading edge of the succeeding sheet 1-B abuts the conveying nip portion at a predetermined amount of conveyance, it is determined that the skew correction operation is to be performed only for the succeeding sheet (step S103), and the determination operation ends (step S104). That is, after the trailing edge of the preceding sheet 1-A passes through the conveying nip portion, only the succeeding sheet 1-B abuts against the conveying nip portion to perform the skew correction operation, and thereafter, cuing is performed in the condition where only the succeeding sheet 1-B is present.

On the other hand, when the leading edge of the succeeding sheet 1-B has reached the determination position P3 (step S102: YES), it is determined whether the trailing edge of the preceding sheet 1-A has passed through the conveying nip portion (step S105). If it is determined that the sheet has passed through (step S105: YES), since the preceding sheet and the succeeding sheet do not overlap each other, the skew correction operation for only the succeeding sheet is determined (step S106). That is, only the succeeding sheet 1-B abuts against the conveying nip portion to perform the skew correction operation, and thereafter, the cuing is performed in a state where only the succeeding sheet 1-B is present.

On the other hand, when it is determined that the trailing edge of the preceding sheet 1-A does not pass through the conveying nip portion (step S105: NO), it is determined whether the overlap amount between the trailing edge portion of the preceding sheet 1-A and the leading edge portion of the succeeding sheet 1-B is smaller than a threshold (step S107). The position of the trailing edge of the preceding sheet 1-A is updated in accordance with the printing operation for the preceding sheet 1-A. The position of the leading edge of the succeeding sheet 1-B is the aforementioned determination position. That is, the overlap amount will decrease along with the printing operation of the preceding sheet 1-A. If it is determined that the overlap amount is smaller than the threshold value (step S107: YES), the overlapping state is released and the skew correction operation for only the succeeding sheet is determined (step S108). That is, after the image forming operation of the preceding sheet 1-A is completed, the succeeding sheet 1-B is not conveyed together with the preceding sheet 1-A. Specifically, the conveyance roller 5 is driven by the conveyance motor 205 to convey the preceding sheet 1-A. However, the feeding roller 3 is not driven. Therefore, the overlapping state is released. Furthermore, only the succeeding sheet 1-B abuts against the conveying nip portion to perform the skew correction operation, and thereafter, the cuing is performed in a state where only the succeeding sheet 1-B is present.

If it is determined that the overlap amount is greater than or equal to the threshold value (step S107: NO), it is determined whether or not the succeeding sheet 1-B reaches the pressing spur 12 when the succeeding sheet 1-B is cued (step S109). If it is determined that the succeeding sheet 1-B has not reached the pressing spur 12 (step S109: NO), the overlapping state is released and the skew correction operation for only the succeeding sheet is determined (step S110). That is, after the image forming operation of the preceding sheet 1-A is completed, the succeeding sheet 1-B is not conveyed together with the preceding sheet 1-A. Specifically, the conveyance roller 5 is driven by the conveyance motor 205 to convey the preceding sheet 1-A. However, the feeding roller 3 is not driven. Therefore, the overlapping state is released. Furthermore, only the succeeding sheet 1-B abuts against the conveying nip portion to perform the skew correction operation, and thereafter, the cuing is performed in a state where only the succeeding sheet 1-B is present.

If it is determined that the succeeding sheet 1-B reaches the pressing spur 12 (step S109: YES), it is determined whether or not there is a gap between the last line of the preceding sheet and the line preceding the last line (step S111). If it is determined that there is no gap (step S111: NO), the overlapping state is released and the skew correction operation for only the succeeding sheet is determined (step S112). If it is determined that there is a gap (step S111: YES), the skew correction operation for the succeeding sheet 1-B is performed while maintaining the overlapping state, and then, cuing is performed. That is, after the image forming operation of the preceding sheet 1-A is completed, the succeeding sheet 1-B is abutted against the conveying nip portion in a state in which it overlaps the preceding sheet 1-A. Specifically, the conveyance roller 5 and the feeding roller 3 are rotated by driving the feed motor 206 simultaneously with the conveyance motor 205. After the skew correction operation, the succeeding sheet 1-B is cued while being overlapped with the preceding sheet 1-A.

In this way, the determination operation is performed to determine whether the preceding sheet 1-A and the succeeding sheet 1-B are maintained in the overlapping state or released.

Figure 11:
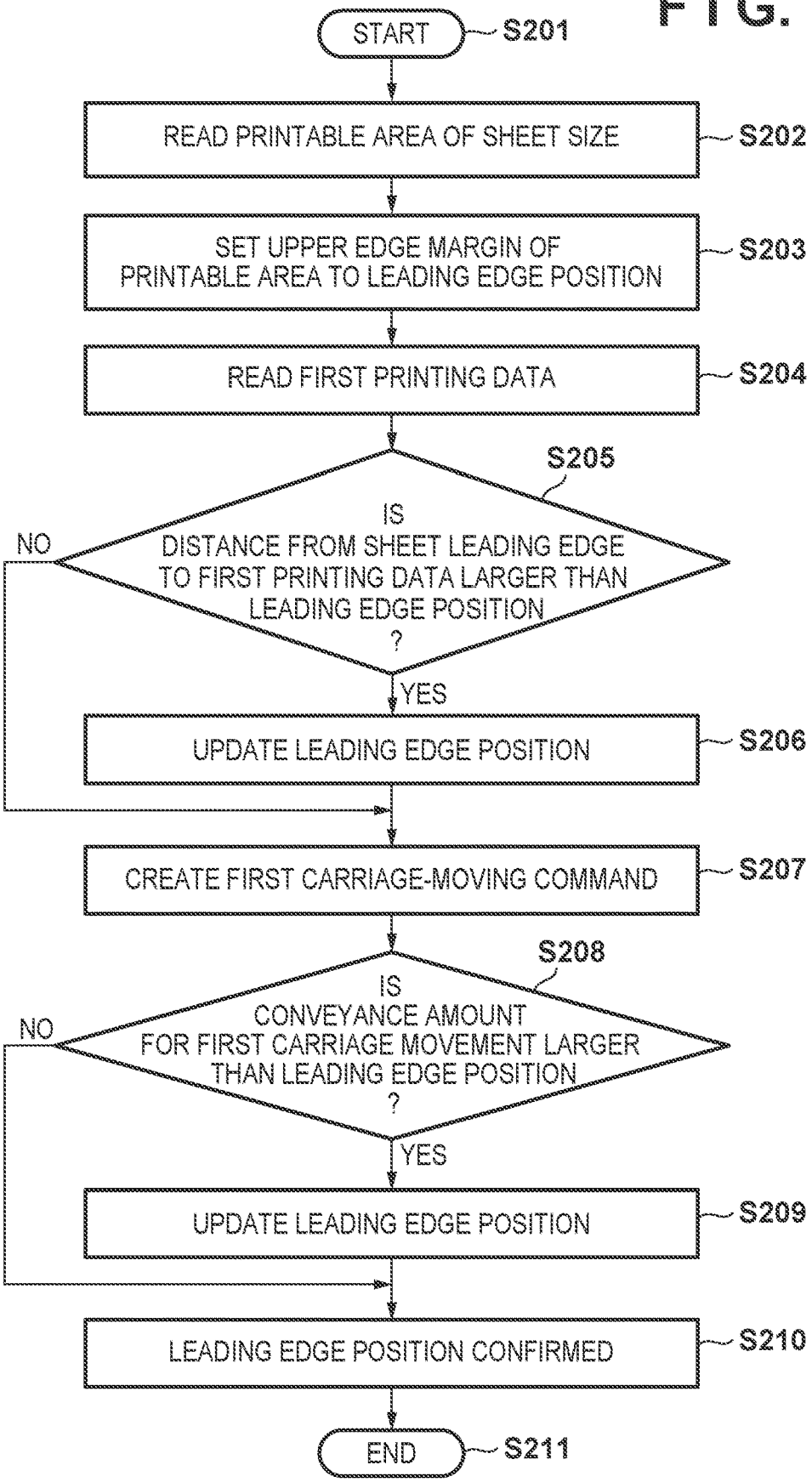
FIG. 11 is a flowchart illustrating an operation of calculating a leading edge position of the succeeding sheet.

FIG. 11 is a flowchart for describing a configuration for calculating the leading edge position after cuing the succeeding sheet in the embodiment.

Processing starts in step S201. In step S202, the printable area of the sheet size is read. Since the leading printable position, in other words, the upper edge margin, is specified, the upper edge margin of the printable area is set to the leading edge position (step S203). Here, the leading edge position is defined by the distance from the conveying nip portion.

Next, first printing data is read (step S204). As a result, the position of the first printing data from the leading edge of the sheet is specified (the non-printing area is detected), and therefore, it is determined whether the distance from the leading edge of the sheet to the first printing data is larger than the leading edge position set previously (step S205). If the distance from the leading edge of the sheet to the first printing data is larger than the leading edge position set earlier (step S205: YES), the leading edge position is updated to the distance from the leading edge of the sheet to the first printing data (step S206). If the distance from the leading edge of the sheet to the first printing data is less than or equal to the leading edge position set earlier (step S205: NO), the processing advances to step S207.

Next, a first carriage-moving command is generated (step S207). Next, a determination is made as to whether or not the sheet conveyance amount for the first carriage movement is larger than the previously set leading edge position (step S208). If the sheet conveyance amount for the first carriage movement is larger than the previously set leading edge position (step S208: YES), the leading edge position is updated to the sheet conveyance amount for the first carriage movement (step S209). If the sheet conveyance amount for the first carriage movement is less than or equal to the leading edge position set previously (step S208: NO), the leading edge position is not updated. As described above, the leading edge position of the succeeding sheet 1-B is determined (step S210), and the processing ends (step S211). Based on the determined leading edge position, it is possible to determine whether or not the succeeding sheet 1-B reaches the pressing spur 12 when the succeeding sheet 1-B is cued (FIG. 10: step S109).

As described above, by virtue of the above-described embodiment, in a case where the conveyance motor 205 rises in temperature and the driving speed during the overlapped continuous feeding is reduced, the overlapped continuous feeding operation is stopped, and the leading edge of the succeeding sheet 1-B is detected by the second sheet detection sensor 18 to thereby enable satisfactory skew correction of the succeeding sheet 1-B.

Second Embodiment

Next, a printing apparatus according to the second embodiment of the present invention is described. In the first embodiment, a printing apparatus in which the overlapped continuous feeding operation is not performed when the conveyance motor 205 is in a temperature rising state was described. In the second embodiment, the temperature rise determination is also performed for the feed motor 206. If the feed motor 206 is determined to be in a temperature rising state during the overlapped continuous feeding, the feeding speed of the feed motor 206 is not increased, and the overlapped continuous feeding operation is not performed. Furthermore, the leading edge of the succeeding sheet 1-B is detected by the second sheet detection sensor 18 and the skew correction is performed. Thus, it is possible to perform satisfactory skew correction of the succeeding sheet 1-B while suppressing a temperature rise of the conveyance motor 205 and the feed motor 206.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-217371, filed Dec. 25, 2020, which is hereby incorporated by reference herein in its entirety.

What is claimed is:

1. A printing apparatus, comprising:

a first roller configured to convey sheets;

a first motor configured to drive the first roller;

a second roller configured to convey sheets conveyed by the first roller;

a second motor configured to drive the second roller; and a conveyance controller configured to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the conveyance controller, based on information indicating whether the second motor is in a temperature rising state, controls whether to execute the first conveyance operation or to execute the second conveyance operation.

2. A printing apparatus, comprising:

a first roller configured to convey sheets;

a first motor configured to drive the first roller;

a second roller configured to convey sheets conveyed by the first roller;

a second motor configured to drive the second roller; and a conveyance controller configured to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the conveyance controller, based on temperature information of the second motor, controls whether to execute the first conveyance operation or to execute the second conveyance operation.

3. The printing apparatus according to claim 2, further comprising a temperature sensor configured to detect a temperature of the first motor or the second motor.

4. The printing apparatus according to claim 1, wherein the conveyance controller, in a case where a temperature indicated by temperature information of the second motor is a temperature rising state temperature, executes the second conveyance operation.

5. The printing apparatus according to claim 1, wherein the conveyance controller, further based on information regarding a temperature rising state of the first motor, controls whether to execute the first conveyance operation or to execute the second conveyance operation.

6. The printing apparatus according to claim 5, wherein the conveyance controller, in a case where a temperature indicated by temperature information of the first motor or the second motor is a rising temperature, executes the second conveyance operation.

7. The printing apparatus according to claim 5, wherein the conveyance controller, based on information of a PWM control when the first motor or the second motor is driven, determines whether the first motor or the second motor is in the temperature rising state.

8. The printing apparatus according to claim 7, wherein the conveyance controller, based on a duty value of the PWM control when the first motor or the second motor is driven, determines whether the first motor or the second motor is in the temperature rising state.

9. The printing apparatus according to claim 1, wherein the conveyance controller, in a case where it is determined that a temperature indicated by temperature information of the second motor is a rising temperature while the first conveyance operation is performed, causes the conveyance of the succeeding sheet to stop.

10. The printing apparatus according to claim 1, further comprising:

a first sheet detector configured to detect sheets; and a second sheet detector arranged downstream of the first sheet detector in the direction of conveyance of sheets and configured to detect sheets.

11. The printing apparatus according to claim 10, wherein the conveyance controller, in a case where it is determined that a temperature indicated by temperature information of the second motor is a temperature of a temperature rising state while the first conveyance operation is performed and the subsequent sheet has not reached the position of the second sheet detector, causes the conveyance of the succeeding sheet to stop.

12. The printing apparatus according to claim 10, further comprising:

a skew correction mechanism configured to correct a skew of a sheet by abutting the sheet conveyed by the first roller to the second roller, wherein the conveyance controller, based on the temperature rising state of the second motor, controls whether to execute the first conveyance operation or to execute the second conveyance operation, and the skew correction mechanism, based on a detection result by the first sheet detector and the second sheet detector in a case where the first conveyance operation is executed, corrects a skew of the succeeding sheet, and based on a detection result of the second sheet detector in a case where the second conveyance operation is executed, corrects a skew of the succeeding sheet.

13. The printing apparatus according to claim 1, wherein the conveyance controller, in a case where a temperature indicated by temperature information of the second motor is a temperature of a temperature rising state, reduces the rotational speed of the second motor.

14. The printing apparatus according to claim 13, wherein the conveyance controller, in the case where the temperature indicated by the temperature information of the second motor is a temperature of the temperature rising state, reduces the rotational speed of the first motor to be less than the rotational speed of the second motor and synchronously drives the second motor.

15. A method of controlling a printing apparatus comprising a first roller for conveying sheets, a first motor for driving the first roller, a second roller for conveying sheets conveyed by the first roller, and a second motor for driving the second roller, the method comprising:

controlling conveyance to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the controlling conveyance, based on information indicating whether the second motor is in a temperature rising state, controls whether to execute the first conveyance operation or to execute the second conveyance operation.

16. A method of controlling a printing apparatus comprising a first roller for conveying sheets, a first motor for driving the first roller, a second roller for conveying sheets conveyed by the first roller, and a second motor for driving the second roller, the method comprising:

controlling conveyance to be able to execute a first conveyance operation for conveying sheets such that the trailing edge of a preceding sheet and the leading edge of a succeeding sheet, which is a sheet conveyed after the preceding sheet, overlap, and a second conveyance operation for conveying sheets by arranging a distance between the trailing edge of the preceding sheet and the leading edge of the succeeding sheet, wherein the controlling conveyance, based on temperature information of the second motor, controls whether to execute the first conveyance operation or to execute the second conveyance operation.

* * * * *